US007354387B2

(12) United States Patent
Giro Amigo

(10) Patent No.: US 7,354,387 B2
(45) Date of Patent: Apr. 8, 2008

(54) FOLDING DEVICE

(75) Inventor: Ezequiel Giro Amigo, Badalona (ES)

(73) Assignee: Giro GH, S.A., Badalona (ES)

( * ) Notice: Subject to any disclaimer, the term of this patent is extended or adjusted under 35 U.S.C. 154(b) by 0 days.

(21) Appl. No.: 11/346,397

(22) Filed: Feb. 3, 2006

(65) Prior Publication Data

US 2006/0176763 A1 Aug. 10, 2006

(30) Foreign Application Priority Data

Feb. 4, 2005 (ES) ..... 200500223

(51) Int. Cl.
*B31C 11/04* (2006.01)

(52) U.S. Cl. ..... 493/278; 493/282; 493/257; 493/243; 493/449

(58) Field of Classification Search ..... 493/278, 493/282, 254, 308, 257, 258, 259, 263, 243, 493/457, 458, 449
See application file for complete search history.

(56) References Cited

U.S. PATENT DOCUMENTS 3,020,599 A * 2/1962 Pukis et al. ..... 28/121
3,090,174 A * 5/1963 Kraft ..... 53/433
3,544,099 A * 12/1970 Cooke et al. ..... 493/418
3,640,521 A * 2/1972 Hutley ..... 493/25
3,657,856 A * 4/1972 Planner ..... 53/481
4,547,184 A * 10/1985 Bunch, Jr. ..... 493/414
4,583,964 A * 4/1986 Warncke ..... 493/308
4,650,447 A * 3/1987 Meschi ..... 493/11
4,655,739 A * 4/1987 Pratt et al. ..... 493/357
4,820,250 A * 4/1989 Bunch, Jr. ..... 493/414
4,982,557 A * 1/1991 Gradwohl ..... 53/370.6
5,080,644 A * 1/1992 Bunch, Jr. ..... 493/411
5,247,780 A * 9/1993 Kulpa et al. ..... 53/381.5
5,775,733 A * 7/1998 Lunt et al. ..... 280/743.1
5,992,132 A * 11/1999 Auerbach ..... 53/569
6,022,432 A * 2/2000 Elsberg et al. ..... 156/73.1
6,113,258 A * 9/2000 Ardent ..... 366/282
6,171,228 B1 * 1/2001 Marotzke et al. ..... 493/405
6,196,585 B1 * 3/2001 Igawa ..... 280/743.1
6,371,646 B1 * 4/2002 LaFleur ..... 383/109
6,432,033 B1 * 8/2002 Salzmann et al. ..... 493/231
6,685,613 B1 * 2/2004 Stopher et al. ..... 493/194
2006/0204150 A1 * 9/2006 Giro Amigo ..... 383/117

* cited by examiner

*Primary Examiner*—Sameh H. Tawfik
(74) *Attorney, Agent, or Firm*—Sughrue Mion, PLLC

(57) ABSTRACT

Folding device, for use in sealing flexible tubular containers by adhering two facing portions on the same end edge, which comprises two groups of rotating paddles that face one another, able to turn simultaneously and so that each paddle in the same group pushes respective portions inside a side of a container positioned between the two groups of paddles, the paddles of the same group being able to move towards or away from one another, and preferably being connected via an element with elastic properties.

5 Claims, 4 Drawing Sheets

FOLDING DEVICE

TECHNICAL FIELD OF THE INVENTION

The invention relates to a folding device, for use in sealing flexible tubular containers by adhering two facing portions on the same end edge.

BACKGROUND OF THE INVENTION

Devices for automatic filling of flexible tubular containers, such as string bags used to contain fruit and vegetables, generally comprise a pair of holding clips which hold the upper opening of the container to be filled, in an open position, while the containers are being filled. Once the container has been filled, it is then sealed, which usually comprises the step of joining the clips holding the container, sealing it at the top to then join two sealing portions, facing one another, on the edge of the upper opening of the container.

In order to ensure the best seal on the container, it is usual to fold the side portions of the container that are between the joined sealing portions, so that the folds produced are interposed, at least partially, between said joined portions. These sides are said to fold or double over like an accordion.

For this purpose, the filling devices comprise folding means each with actuators facing outwards onto the sides of the container to be folded. These actuators move towards the container, pushing both side portions of the container inside the container, while the two sealing portions are joined by bringing together the holding clips. The pushing of these actuators produces a fold in each side of the container in the area close to its upper edge.

In order to ensure the folding of the sides of the container, the actuators must remain partially inside the container, pushing the side portions of the container inside the container, while the two sealing portions are joined. It is also usual for the filling devices to have a holding clip, positioned at a lower level, which closes to fasten the container once it has been filled, to transport the container to a station following that of sealing the fastening, for example, by heat-sealing the joined sealing portions in the filling station.

To date, two single actuators are used that produce a single fold in each side of the container, a fold that is made in the middle of each side, or in other words, centred with respect to the width of the container. This is because the presence of the actuators must not prevent the holding clips from coming together to seal the top of the container.

On many occasions, it is of particular interest to produce more than one fold in the container sides as long as the two sealing portions join to seal the top of the container, but no device is known to exist for multiple folding, while allowing the container to be sealed automatically as this operation does in filling devices of the type described earlier.

It should also be mentioned that the actuators of said devices usually introduce excess pressure on the wires or tapes comprising the mesh of the containers when the actuators push the respective side portions of the containers inwards. This excess pressure may damage or even break the mesh comprising the containers during subsequent handling of the filled containers.

EXPLANATION OF THE INVENTION

The folding device being the object of the invention, can be used to seal flexible tubular containers, such as, for example, string bags, by adhering two facing portions on the same end edge.

In essence, the device of the invention is characterized in that it comprises two groups of rotating paddles that face one another, able to turn simultaneously and so that each paddle in the same group pushes respective portions inside a side of a container positioned between the two groups of paddles, and in that the paddles of the same group can move towards or away from one another.

The paddles can thus push respective portions of the container sides inside the container, when the upper portion of the container has a determined width, producing folds in said sides, while they allow the container to be sealed by joining, or adhering, both sealing portions, reducing the width of the upper portion of the container in which the paddles are functioning.

According to another characteristic of the invention, the paddles of each group are pulled in their turning movement by the same rotating axle so that the paddles of the same group can switch, simultaneously and alternately, first in the direction of the container to be sealed and subsequently in the opposite direction in each operating cycle of the device, and the drive shafts of the two groups of paddles are parallel and positioned at the same height.

According to a preferred embodiment of the invention, each group comprises two paddles and the two paddles of the same group are attached to the respective rotating axle and can move freely along a predetermined stretch of said axle, whereby each paddle being positioned on one of the ends of said stretch, both paddles can be moved simultaneously in opposite directions, moving towards one another, and subsequently moving in opposite directions to the first, moving away from one another, in each operating cycle of the device.

In accordance with another characteristic of the invention, the two paddles of the same group are connected to one another via an element with elastic properties which acts under compression, so that starting from an initial position in which each paddle is situated on one of the ends of said predetermined stretch, if these are actively pulled in opposite directions, moving towards one another, the element with elastic properties is compressed, and once said pulling force on the paddles ceases to be exerted, both paddles automatically separate when the element with elastic properties returns to its original form.

In a preferred embodiment, the elements with elastic properties are comprised of two springs that act under compression.

In accordance with another characteristic of the invention, the paddles of each group are configured as a flat plate and have in one of their side edges a respective appendage in the form of a hook suitable for supporting the container during the turning movement of the paddles in the direction towards the container to be sealed and because each paddle is comprised of a main body which can be coupled to the respective rotating axle of the group of paddles; an end portion, with the appendage, joined in an articulated way to the main body at its free end opposite to the respective rotating axle of the group of paddles and suitable for turning in a coplanar manner around a spin axle with respect to the main body, from an initial position; and elastic means which act permanently under stress on said end portion and hold it in the initial position, folded over on the main body of the paddle, so that if a predetermined force is exerted by the container on the appendage, the end portion turns, the appendage defining a curvilinear path with respect to the spin axle of the end portion and, when said force ceases, it returns to its initial position in response to the elastic means. In this way, the excess pressure is removed on the wires or tapes comprising the container meshes when the paddles push the respective side portions of the containers inwards.

In accordance with another characteristic of the invention, the end portion of each paddle is comprised of means for blowing air in the direction of the respective side of the container wherein a respective fold is made. Said means for blowing air allow small stretches of the filaments, which form the wires or tapes that may be in the sides of the container wherein the folds are made, to remain positioned in the direction of said folds and, therefore, said stretches do not protrude from the sides of the adhered facing portions of the container.

BRIEF DESCRIPTION OF THE DRAWINGS

In the attached drawings is an illustration of a form of embodiment of the device being the object of the invention. In said drawings.

DETAILED DESCRIPTION OF THE DRAWINGS

Figure 1:
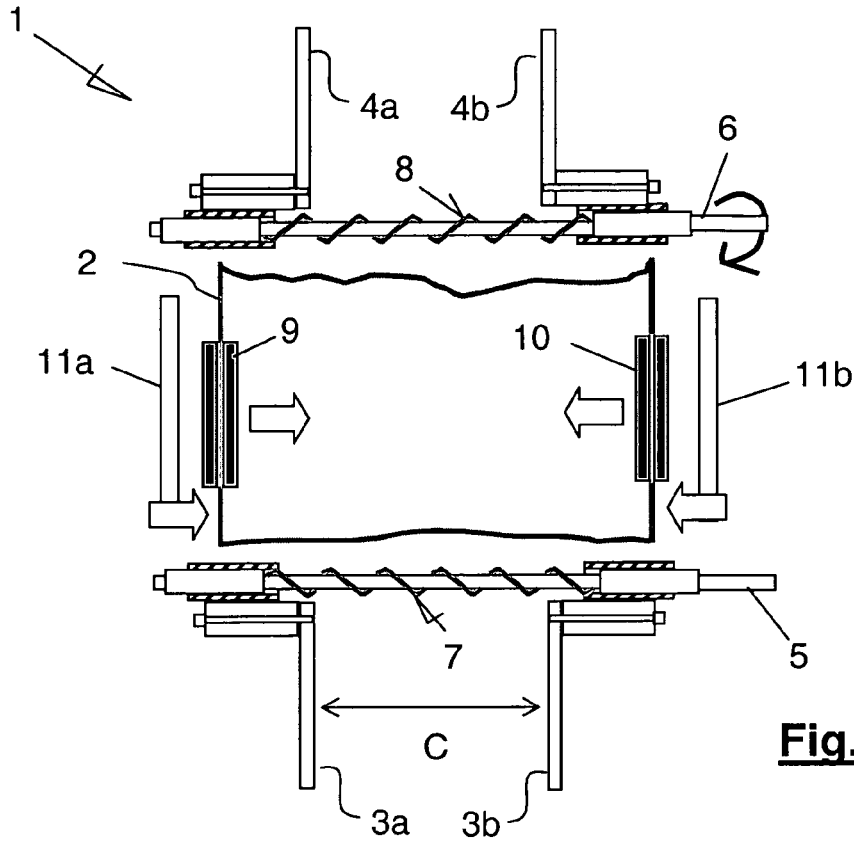
FIGS. 1 to 3 are diagrammatic ground views of the device of the invention, according to three positions occupied by said device in a sealing operation of a container.
Figure 2:
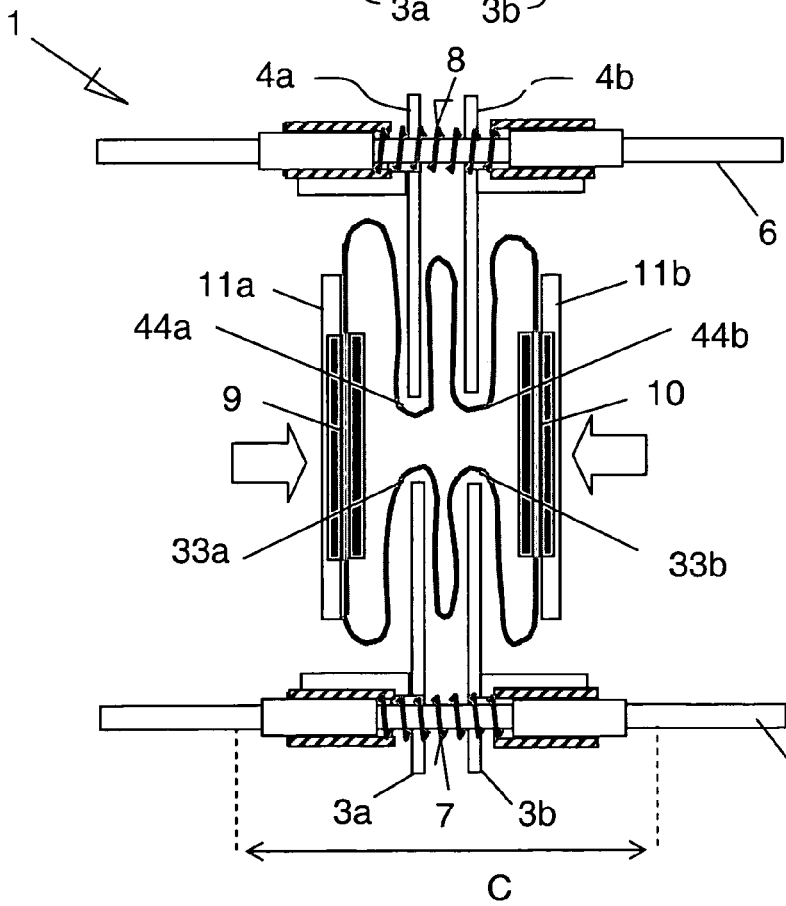
Figure 3:
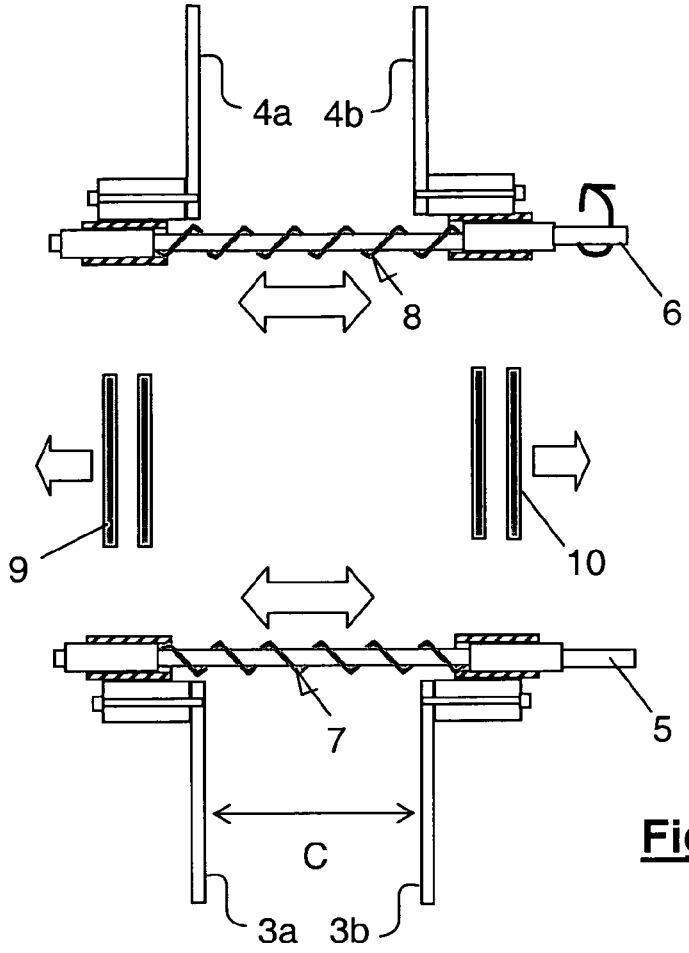

The folding device diagrammatically represented in FIGS. 1 to 3, comprises two rotating axles 5 and 6 positioned parallel to one another and at the same height. The device also has two groups of paddles, attached to said axles 5 and 6, the first group being formed by the paddles 3*a* and 3*b* while the second group is formed by the paddles 4*a* and 4*b*.

The two paddles 3*a*, 3*b* and 4*a*, 4*b* of each group are attached to their respective rotating axles 5 and 6, so that on turning said axles, the two paddles of the same group turn simultaneously. In addition, the two axles 5 and 6 are separated by a determined distance, so that a container 2 can be positioned between said axles 5 and 6 with the paddles 3*a*, 3*b* and 4*a*, 4*b* being in the position indicated in FIG. 1, without obstructing transport of the container to the position represented therein.

Paddles 3*a*, 3*b* and 4*a*, 4*b* are also attached to their corresponding axles 5 and 6 so that they can move freely along both stretches C of each axle, giving each paddle two degrees of freedom of movement. Each paddle thus has the capacity to both turn and move along its rotating axle, the two movements being able to occur simultaneously or consecutively.

In the embodiment in the drawings, the two paddles of each group are connected via an element with elastic properties 7 and 8. In a particular embodiment, the paddles 3*a* and 3*b* are connected via a spring 7 which acts under compression while the paddles 4*a* and 4*b* are connected via a spring 8, the same as spring 7, which also acts under compression.

As a consequence, the two paddles 3*a* and 3*b* can move actively along their axle 5, coming together in opposite directions and the spring 7 that joins them being compressed. In the same way, the paddles 4*a* and 4*b* can mutually move towards one another, the spring 8 that joins them, being compressed as a consequence (see FIG. 2). The paddles can actively return to their original position, upon being driven by a mechanism provided for such purpose, or automatically, upon the springs 7 and 8 returning to their original forms, expanding and pushing the paddles 3*a*, 3*b* and 4*a*, 4*b* to their original position (see FIG. 3). In all cases, buffer-end elements are provided in the stretches C for movement of the axles 5 and 6 to retain the paddles 3*a*, 3*b* and 4*a*, 4*b* against said buffers via the effect of the springs 7 and 8, occupying by default the position represented in FIG. 1.

In accordance with the characteristics described earlier, the device 1 of the invention, as an integral part of a conventional automatic device for filling containers, functions in the following way:

At the outset, the paddles 3*a*, 3*b* and 4*a*, 4*b* are in the position indicated in FIG. 1, extending outwards, or in other words, in the opposite direction to the position occupied by a container 2 situated between the rotating axles 5 and 6 on the automatic filling device. The paddles 3*a*, 3*b* and 4*a*, 4*b* are turned so that they do not prevent the container held by the holding clips 9 and 10 from moving forwards, which is transported perpendicularly with respect to the axles 5 and 6, for supporting and turning the paddles.

Figure 4:
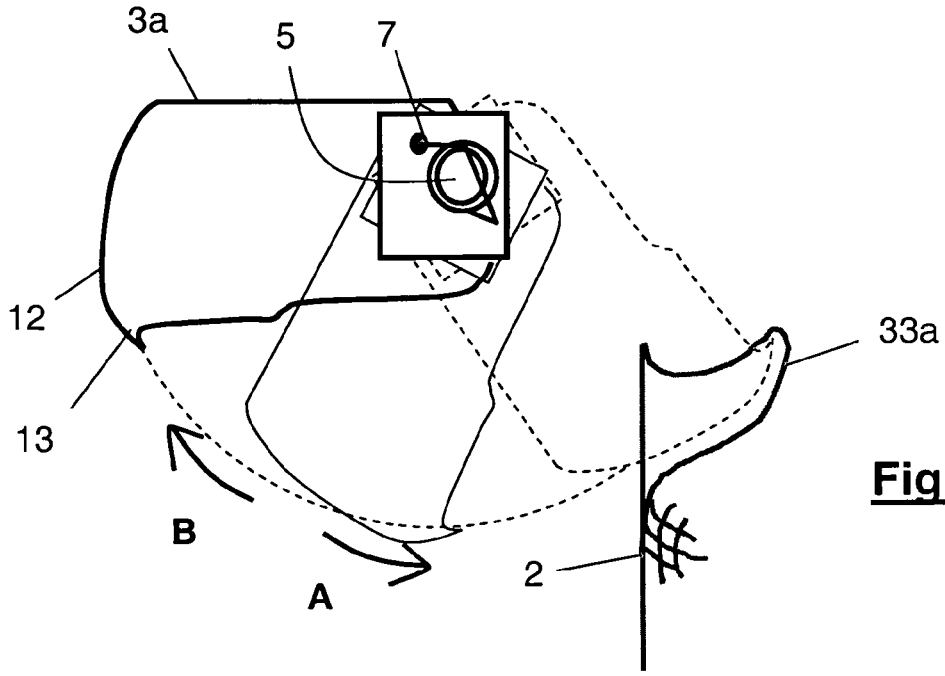
FIG. 4 is a side view, also diagrammatic, of a paddle of the device according to the invention, represented according to different positions around a rotating axle.

When the container 2 is in an intermediate position, centred with respect to the axles 5 and 6, as shown in FIG. 1, first the container is filled and then it is sealed. To do this, the holding clips 9 and 10 move towards one another to seal the top of the container 2, while the paddles 3*a*, 3*b* and 4*a*, 4*b* turn in the direction indicated by arrow A in FIG. 4, so that the ends 12 of the paddles push side portions of the container 2 inside the container itself. In the case of the example, the paddles 3*a* and 3*b* push the side portions 33*a* and 33*b* inside the container, producing two contiguous folds in this side of the container 2. Simultaneously, the paddles 4*a* and 4*b* push respective portions 44*a* and 44*b* of the other side of the container 2, producing two folds in this side of the container 2, all this as indicated in FIG. 2.

Insofar as the clips 9 and 10 move towards one another, so too do the paddles 3*a* and 3*b* on one side of the container, as do the paddles 4*a* and 4*b* on the other side of the container, moving along their respective rotating axles 5 and 6, forming the two folds described earlier. Provision is made for the two paddles 3*a*, 3*b* and 4*a*, 4*b* to be pulled mechanically either by the clips 9 and 10 or by the clamps 11*a* and 11*b*, respectively, from the clip used to transport the container 2 to another station in which the container 2 will be sealed. Naturally, when the paddles 3*a* and 3*b* move towards one another, the spring 7 is compressed, while the spring 8 is compressed when the paddles 4*a* and 4*b* move towards one another.

These clamps 11*a* and 11*b* hold the already sealed container and transport it to another section, before the holding clips 9 and 10 open, releasing the container 2 and withdrawing to their original position as indicated in FIG. 3. When this happens, the paddles 3*a*, 3*b* and 4*a*, 4*b* return to their initial position, automatically, via the elastic reaction of the springs 7 and 8 which recover their original form. At the same time, the paddles 3*a*, 3*b* and 4*a*, 4*b* turn around their respective axles 5 and 6 in the direction indicated by arrow B in FIG. 4, until they take up their initial position to receive the following container 2 to be filled and sealed.

The profile of the paddles 3*a*, 3*b* and 4*a*, 4*b* is essentially rectangular, the rotating axle 5 or 6 being attached at one of their smaller sides, while their other smaller side is slightly rounded and has, on its front vertex with respect to the position of the container 2, a projection with an acute profile or appendage 13.

The number of paddles forming each group may vary, in such a way that the more paddles there are, the greater number of folds in the sides of the container. It should be pointed out that the initial separation between the paddles of the same group must be sufficient for each paddle to push a portion of one side of a container to produce a line of folding between both paddles, which does not occur when the paddles of the same group are too close to one another and/or the material of the container presents certain resistance to folding.

Figure 5:
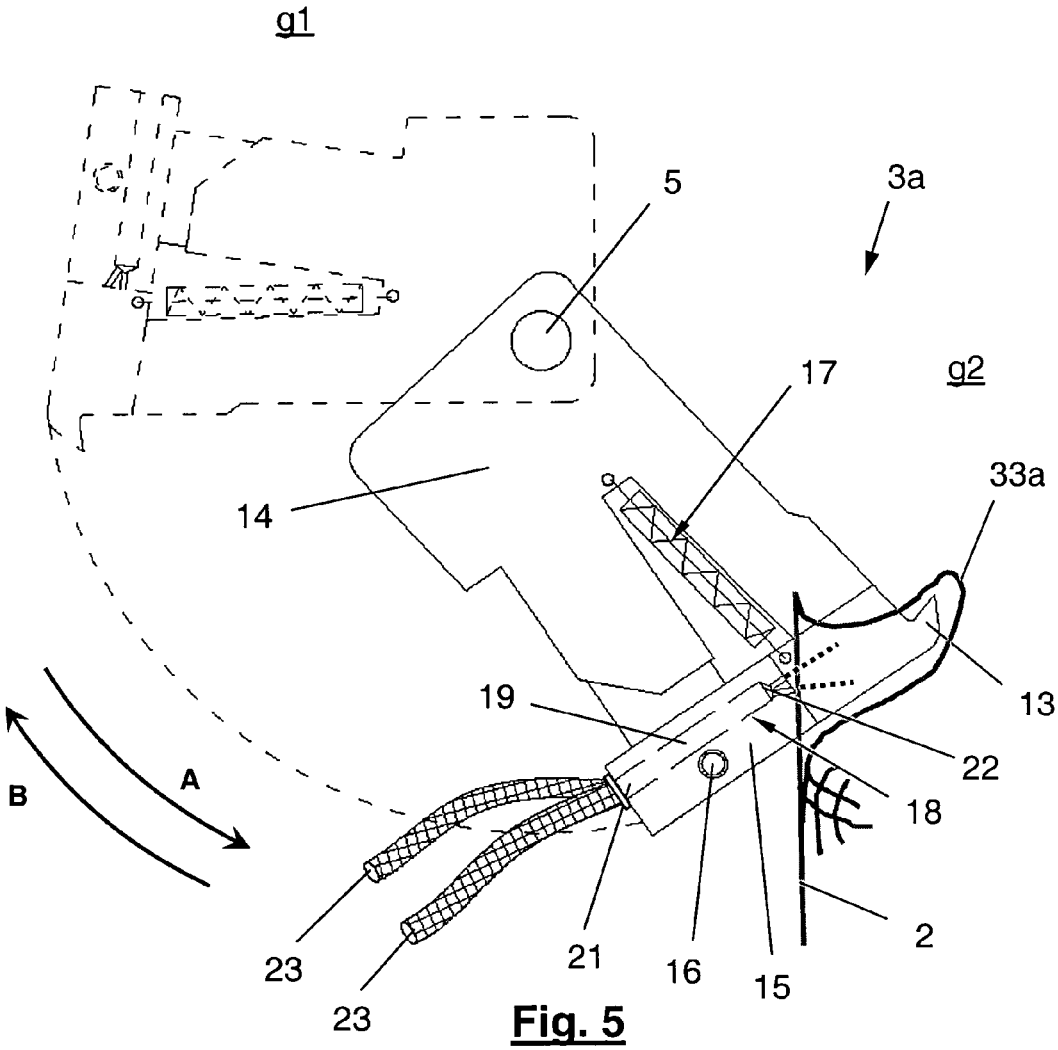
FIG. 5 is a diagrammatic side view of another embodiment of a paddle of the device of the invention, represented in a turning swinging movement around its rotating axle, whose end portion is in the initial position.
Figure 6:
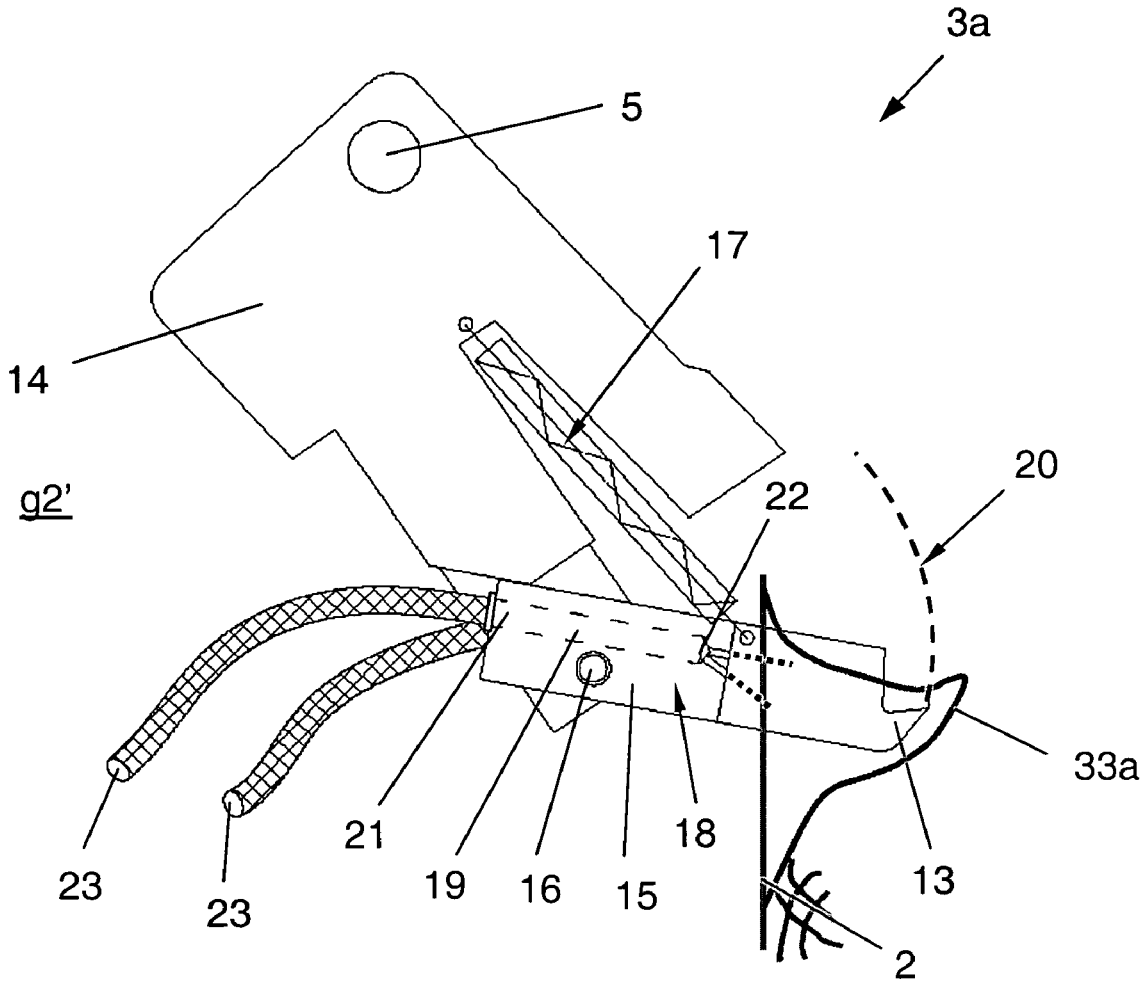
FIG. 6 is another diagrammatic view of the paddle in FIG. 5, wherein its end portion is in maximum turning position with respect to the main body of the paddle.

It should be mentioned that the paddles 3*a*, 3*b* and 4*a*, 4*b* are configured as a flat plate and that, according to the embodiment represented in FIGS. 5 and 6, each paddle 3*a*, 3*b*, 4*a*, 4*b* comprises a main body 14 and an end portion 15 wherein there is an appendage 13 in the form of a hook suitable for holding the container 2 to be sealed. The main body 14 can be coupled with respect to the rotating axle 5 or 6 which transmits to it the turning back and forth movement around itself, first in direction A and then in opposite direction B, in each operating cycle for sealing the container 2, as represented in FIG. 5.

As for the end portion 15, this is joined in an articulated way to the main body 14 at its free end opposite to its respective rotating axle 5 or 6, which is why it can turn, in a coplanar manner with respect to the main body 14, around a spin axle 16 from an initial position wherein the end portion 15 is folded over on the main body 14, the position of the paddle 3*a* in FIG. 5, up to a maximum relative turning position between the main body 14 and the end portion 15, represented in FIG. 6.

As can be seen in FIGS. 5 and 6, the paddle 3*a* shown also comprises elastic means 17 which permanently act under stress on the end portion 15 and hold it in the initial position, in other words, folded over on the main body 14 of the paddle 3*a*. The end portion 15 will abandon its initial position when the container 2 to be sealed exerts a predetermined force on the appendage 13, a time when said portion will turn with respect to the spin axle 16 and its appendage 13 will define a curvilinear path 20 with respect to said spin axle 16 shown in FIG. 6. When said predetermined force on the appendage 13 ceases, for example when the paddle 3*a* stops turning in direction of B in FIG. 5, the end portion 15 will return to its initial position in response to the elastic means 17. Particularly, the elastic means 17 are comprised of a preset spring whose ends are joined to the main body 14 and to the end portion 15, respectively, and can be housed in an opening of the main body 14 made for such purpose in its free end opposite the respective rotating axle 5 or 6 of the group of paddles 3*a*, 3*b* and 4*a*, 4*b*.

It should be mentioned that in position g1 and in position g2 represented in FIG. 5, the end portion 15 is folded over on the main body 14 of the paddle 3*a*, in other words, it remains in its initial position due to the action of the elastic means 17.

When the respective portions 33*a*, 33*b* and 44*a*, 44*b* of the respective sides of the container 2 are pushed by the corresponding paddle 3*a*, 3*b* and 4*a*, 4*b*, the appendage 13 on its end portion 15 hooks on and, in its turning movement with respect to the respective rotating axle 5 or 6, holds one or several graticules of the mesh which forms the flexible tubular container 2. In many cases, the weight of the container 2 when filled with products exerts a force on the appendage 13 generating unwanted excess pressure on the wires or tapes of the mesh which may damage and even break the container 2 during subsequent handling.

To avoid this drawback, the end portion 15 of each of the paddles 3*a*, 3*b* and 4*a*, 4*b* can turn with respect to the main body 14 around the spin axle 16. As a result, when the container 2 exerts a predetermined force on the appendage 13 of the paddle 3*a*, 3*b*, 4*a*, 4*b*, which holds at least one graticule of the mesh, the appendage 13 gives way under said force and the end portion 15 turns around the spin axle 16, the appendage 13 defining the curvilinear path 20 indicated in FIG. 6. In said curvilinear path 20, the appendage 13 moves away from the main body 14 and in this way loosens the wires or tapes which comprise the container mesh 2 and which previously were straps for moving the paddle 3*a*, 3*b* and 4*a*, 4*b* in direction A, in the opposite direction from the force applied to the appendage 13. It should also be added to the above that once the end portion 15 has abandoned its initial position, wherein it was folded over on the main body 14, it does not prevent the paddle 3*a*, 3*b* and 4*a*, 4*b* from continuing to turn with respect to the respective rotating axle 5, 6.

Turning of the end portion 15 with respect to the main body 14 is restricted by the elastic constant of the preset spring which makes up the elastic means 17 which connect both parts of each paddle 3*a*, 3*b* and 4*a*, 4*b*. Furthermore, according to the embodiment represented in FIGS. 5 and 6, this relative turn is also restricted by a bevelled edge of the main body 14 which serves as a buffer. Position g2' of the maximum relative turn between the main body 14 and the end portion 15 is the one represented in FIG. 6, wherein it can be seen that one of the edges of the end portion 15 comes up against the bevelled edge of the main body 14, preventing said end portion 15 from turning beyond this position.

When this predetermined force on the appendage 13 of the paddle 3*a*, 3*b*, 4*a*, 4*b* ceases, the end portion 15 returns to its initial position, again folding over on the main body 14 due to the stress from the elastic means 17.

As can be seen in FIGS. 5 and 6, in the sides of the end portion 15 of the paddle 3*a* shown, are means for blowing air 18 in the direction of the side of the container 2 wherein the respective fold is made.

These means 18 on the paddles 3*a*, 3*b*, 4*a*, 4*b* for blowing air, allow situations to be avoided where it can be seen that from the sides of the adhered facing portions of a container small stretches of filaments protrude that comprise the wires or tapes which form the container, causing a poor presentation of the container when filled with a product. Said means 18 on the paddles 3*a*, 3*b*, 4*a*, 4*b* for blowing air, expel air in the direction of the container to be sealed 2, allowing any filaments there may be in the sides of the container 2 wherein the folds are made to remain positioned in the direction of said folds and without protruding from the sides of said adhered facing portions of the container 2.

According to the embodiment of the paddle 3*a* represented in FIGS. 5 and 6, the means for blowing air 18 are comprised of two pipes 19, one in each side of the end portion 15. Each pipe 19 has a first open end 21 for receiving the plug or connection for a flexible pipe 23 for conducting air under pressure and a second open blowing end 22, through which the air is expelled in the direction of the container 2 to be sealed.

In this way, at the same time as each fold is made in a respective side of the container 2, when the paddles 3*a*, 3*b* and 4*a*, 4*b* are, for example, in position g2 or g2', the air under pressure is expelled by the second open blowing end 22 of each pipe 19 so that all the portions of filaments are contained between the two facing portions that will be adhered together and sealed when the container 2 is sealed.

It should be mentioned that the flexible pipes 23 for conducting air under pressure joined to the first open ends 21 of both pipes 19 are sufficiently flexible to accompany their respective paddle 3*a*, 3*b*, 4*a*, 4*b*, both in the turning back and forth movement in directions A and B and in the relative turning movement between the main body 14 and the end portion 15, without interfering with their progression, it also being able to blow air under pressure whenever required.

The invention claimed is:

1. A folding device for sealing a flexible tubular container by adhering two facing portions on a same end edge of the tubular container, the folding device comprising:

a first group of paddles; and a second group of paddles, wherein the first group of paddles and second group of paddles face one another, wherein, when a container to be processed is positioned between the first group of paddles and the second group of paddles, the paddles in the first group are configured to rotate simultaneously such that each of the paddles in the first group pushes a respective portion inside a side of the container, and the paddles in the second group are configured to rotate simultaneously such that each of the paddles in the second group pushes a respective portion inside another side of the container, wherein the paddles in the first group are configured to move towards or away from one another, and the paddles of the second group are configured to move towards or away from one another, wherein the paddles of each of the first and second groups are rotated by a first and second rotating axle, respectively, so that the paddles of each of the first and second groups can switch, simultaneously and alternately, rotating first in a direction of the container and subsequently in an opposite direction of the container in each operating cycle of the device, wherein the first and second rotating axles are parallel and positioned at the same height, wherein each of the first and second groups comprises two paddles, the two paddles of the first group are attached to the first rotating axle and can move freely along a length of the first rotating axle, each paddle of the first group being positioned on opposite ends of said length of the first rotating axle can be moved simultaneously in opposite directions towards one another, and subsequently moved in opposite directions away from one another, in each operating cycle of the device, the two paddles of the second group are attached to the second rotating axle and can move freely along a length of the second rotating axle, each paddle of the second group being positioned on opposite ends of said length of the second rotating axle can be moved simultaneously in opposite directions towards one another, and subsequently moved in opposite directions away from one another, in each operating cycle of the device.

2. The folding device according to claim 1, wherein the two paddles of each of the first and second groups are connected to one another via a first and second element, respectively, wherein each of the first and second elements has elastic properties and acts under compression, wherein starting from an initial position wherein each paddle of the first group is situated on one of the ends of said length of the first rotating axle, if the paddles of the first group are actively pulled in opposite directions towards one another, the first element is compressed, and once a pulling force on the paddles of the first group ceases to be exerted, both paddles of the first group automatically separate when the first element returns to its original form, and wherein starting from an initial position wherein each paddle of the second group is situated on one of the ends of said length of the second rotating axle, if the paddles of the second group are actively pulled in opposite directions towards one another, the second element is compressed, and once a pulling force on the paddles of the second group ceases to be exerted, both paddles of the second group automatically separate when the second element returns to its original form.

3. The folding device according to claim 2, wherein each of the first and second elements is comprised of a spring that acts under compression.

4. The folding device according to claim 1, wherein the paddles of each of the first and second groups are configured in the form of a flat plate and have in one of their side edges a respective appendage in the form of a hook suitable for holding the container during the rotating of the paddles in the direction of the container and wherein each paddle is comprised of:

a main body which can be joined to first and second rotating axles of the first and second groups of paddles, respectively;

an end portion, with the appendage, joined in an articulated way to the main body at its free end opposite to the first and second rotating axles of the first and second groups of paddles, respectively, and suitable for turning in a coplanar manner around a spin axle with respect to the main body, from an initial position; and elastic means which permanently act under stress on said end portion and hold it in the initial position, folded over on the main body of the paddle, so that if a predetermined force is exerted by the container on the appendage, the end portion turns, the appendage defining a curvilinear path with respect to the spin axle of the end portion and, when said force ceases, it returns to its initial position in response to the elastic means.

5. The folding device according to claim 1, wherein the end portion of each paddle of the first and second groups is comprised of means for blowing air in the direction of the side of the container and the another side of the container, respectively, wherein a respective fold is made.

* * * * *